US009376939B2

(12) United States Patent
Berhin et al.

(10) Patent No.: US 9,376,939 B2
(45) **Date of Patent: *Jun. 28, 2016**

(54) CAMSHAFT PHASER

(71) Applicant: DELPHI TECHNOLOGIES, INC., Troy, MI (US)

(72) Inventors: Rodrigue Berhin, Arlon (BE); David Pascal, Beidweiler (BE); Pierre Kimus, Attert (BE)

(73) Assignee: Delphi Technologies, Inc., Troy, MI (US)

( * ) Notice: Subject to any disclaimer, the term of this patent is extended or adjusted under 35 U.S.C. 154(b) by 7 days.

This patent is subject to a terminal disclaimer.

(21) Appl. No.: 14/307,695

(22) Filed: Jun. 18, 2014

(65) Prior Publication Data

US 2015/0369088 A1 Dec. 24, 2015

(51) Int. Cl.

| | |
|---|---|
| ***F01L 1/34*** | (2006.01) |
| ***F01L 1/344*** | (2006.01) |
| ***F01M 1/12*** | (2006.01) |

(52) U.S. Cl.
CPC . *F01L 1/344* (2013.01); *F01M 1/12* (2013.01)

(58) Field of Classification Search
CPC ..... F01L 1/344; F01M 1/12
USPC ..... 123/90.15
See application file for complete search history.

(56) References Cited

U.S. PATENT DOCUMENTS

| | | | | |
|---|---|---|---|---|
| 5,361,735 | A | 11/1994 | Butterfield et al. | |
| 9,016,250 | B2 * | 4/2015 | David | F01L 1/344 123/90.15 |
| 2014/0150742 | A1 | 6/2014 | Kinouchi | |
| 2014/0245978 | A1 | 9/2014 | Tadokoro et al. | |

* cited by examiner

*Primary Examiner* — Zelalem Eshete
(74) *Attorney, Agent, or Firm* — Joshua Mahines

(57) ABSTRACT

An internal combustion includes a crankshaft and a camshaft rotatable by the crankshaft. The internal combustion engine also includes an oil source, an engine cover, and a drive member disposed within the engine cover for transferring rotational motion from the crankshaft to the camshaft. A camshaft phaser actuated by an electric motor is disposed within the engine cover for controllably varying the phase relationship between the crankshaft and the camshaft. A supply passage communicates oil from the oil source to the camshaft phaser in order to lubricate the camshaft phaser and a drain passage drains oil from the camshaft phaser to the oil source. A sealing arrangement defines a dry zone within the engine cover to isolate the drive member from oil used to lubricate the camshaft phaser. The sealing arrangement includes an electric motor to camshaft phaser seal to seal between the electric motor and the camshaft phaser.

18 Claims, 7 Drawing Sheets

CAMSHAFT PHASER

TECHNICAL FIELD OF INVENTION

The present invention relates to an internal combustion engine with a camshaft phaser which uses an electric motor to vary the phase relationship between a crankshaft and a camshaft of the internal combustion engine; more particularly, to such an internal combustion engine which uses oil from the internal combustion engine to lubricate elements of the camshaft phaser; even more particularly to such an internal combustion engine which includes a drive belt for transmitting rotational motion from the crankshaft to the camshaft; and yet even more particularly to such an internal combustion engine which includes a sealing arrangement to seal the drive belt from the oil used to lubricate the camshaft phaser.

BACKGROUND OF INVENTION

Camshaft phasers for varying the timing of combustion valves in internal combustion engines are well known. A first element, known generally as a sprocket element, is driven by a chain, belt, or gearing from the internal combustion engine's crankshaft. A second element, known generally as a camshaft plate, is mounted to the end of a camshaft of the internal combustion engine. A common type of camshaft phaser used by motor vehicle manufactures is known as a vane-type camshaft phaser. U.S. Pat. No. 7,421,989 shows a typical vane-type camshaft phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the angular position of the rotor relative to the stator, and consequently the angular position of the camshaft relative to the crankshaft, as required to meet current or anticipated engine operating conditions.

While vane-type camshaft phasers are effective and relatively inexpensive, they do suffer from drawbacks such as slow operation at low engine speeds due to low oil pressure, slow operation at low engine temperatures due to high oil viscosity, increased oil pump capacity requirement for the oil pump used to lubricate the internal combustion because the same pump is used to actuate the vane-type camshaft phaser, and the total amount of phase authority provided by vane-type camshaft phasers is limited by the amount of space between adjacent vanes and lobes and may not be sufficient to provide the desired amount of phase authority. For at least these reasons, the automotive industry is developing electrically driven camshaft phasers.

One type of electrically driven camshaft phaser being developed uses a harmonic drive gear unit, actuated by an electric motor, to change the angular position of the camshaft relative to the crankshaft. One example of such a camshaft phaser is shown in United States Patent Application Publication No. US 2012/0312258 A1 to Kimus et al. While the camshaft phaser of Kimus et al. does not use oil to actuate the camshaft phaser, oil is used for lubrication of various element of the camshaft phaser. Accordingly, oil is supplied under pressure to the camshaft phaser where the oil lubricates various elements within the camshaft phaser. After lubricating the various elements, the oil which drains out of the camshaft phaser through various interfaces is allowed to reach a drive member, such as a chain or belt, which transfers rotational motion from the crankshaft to the camshaft phaser. While this may be acceptable to some drive members, particularly chains and gears, other drive members, particularly belts, may not tolerate exposure to oil.

U.S. patent application Ser. No. 13/920,182 to Kimus et al., the disclosure of which is incorporated herein by reference in its entirety, teaches an electrically driven camshaft phaser which provides a sealing arrangement to isolate the drive belt from oil used to lubrication the camshaft. While this arrangement of Kimus et al. may be effective, additional sealing arrangements may be desirable.

What is needed is an electrically driven camshaft phaser which minimizes or eliminates one of more of the shortcomings as set forth above.

SUMMARY OF THE INVENTION

Briefly described, an internal combustion engine includes a crankshaft rotatable about a crankshaft axis and a camshaft rotatable by the crankshaft about a camshaft axis. The internal combustion engine also includes an oil source, an engine cover, and a drive member disposed within the engine cover for transferring rotational motion from the crankshaft to the camshaft. A camshaft phaser is disposed within the engine cover for controllably varying the phase relationship between the crankshaft and the camshaft. The camshaft phaser includes an input member driven by the drive member, an output member rotatable with the camshaft, a gear drive unit connecting the input member to the output member, and an electric motor connected to the gear drive unit to impart rotation on the gear drive unit such that rotation of the gear drive unit causes relative rotation between the input member and the output member. A supply passage communicates oil from the oil source to the camshaft phaser in order to lubricate the camshaft phaser and a drain passage drains the oil from the camshaft phaser to the oil source. A sealing arrangement defines a dry zone within the engine cover to isolate the drive member from the oil used to lubricate the camshaft phaser. The sealing arrangement includes an electric motor to camshaft phaser seal to seal between the electric motor and the camshaft phaser.

BRIEF DESCRIPTION OF DRAWINGS

This invention will be further described with reference to the accompanying drawings in which.

DETAILED DESCRIPTION OF INVENTION

Figure 1:
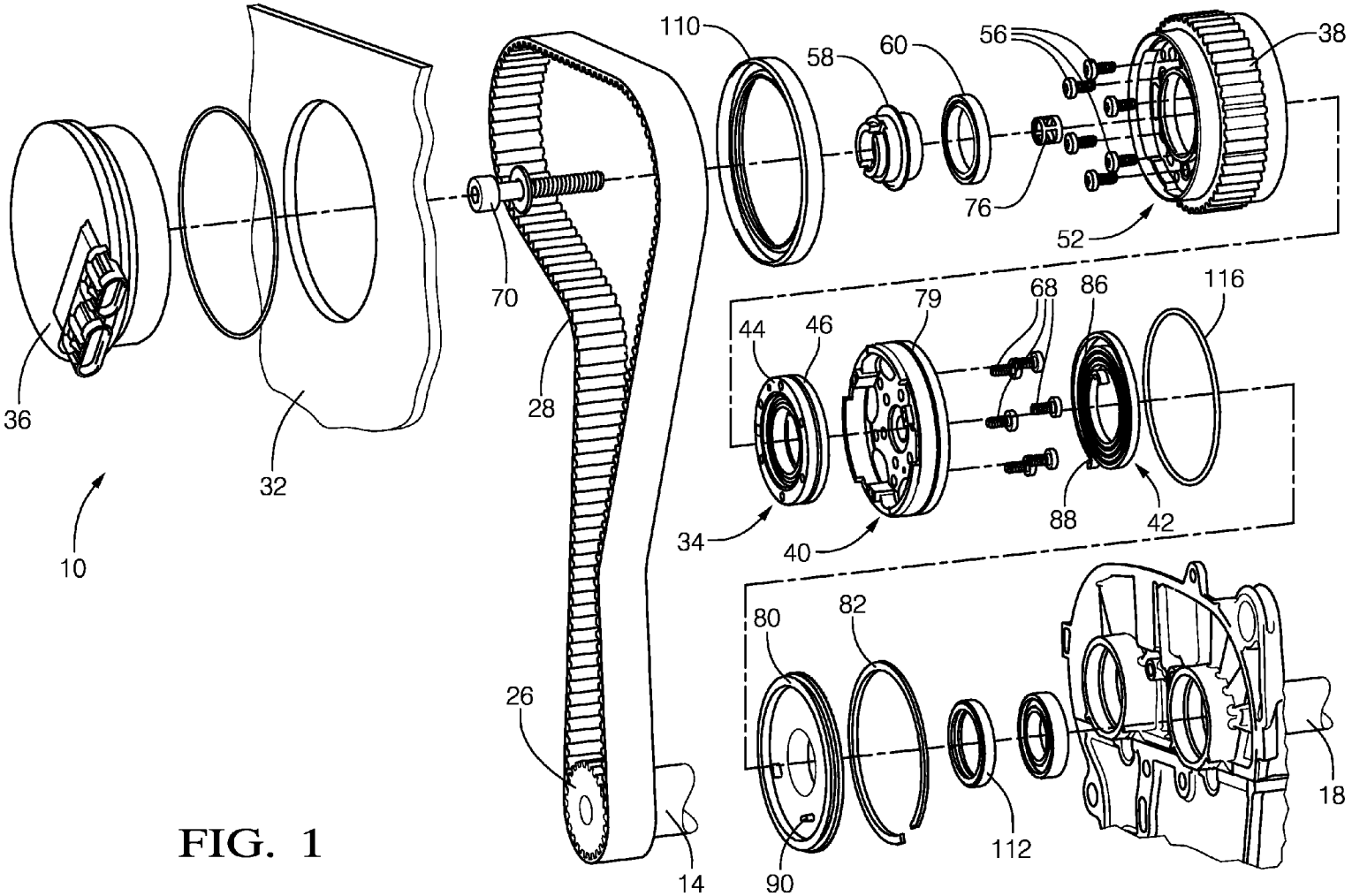
FIG. 1 is an exploded isometric view of an internal combustion engine in accordance with the present invention with a sealing arrangement defining a dry zone.
Figure 2:
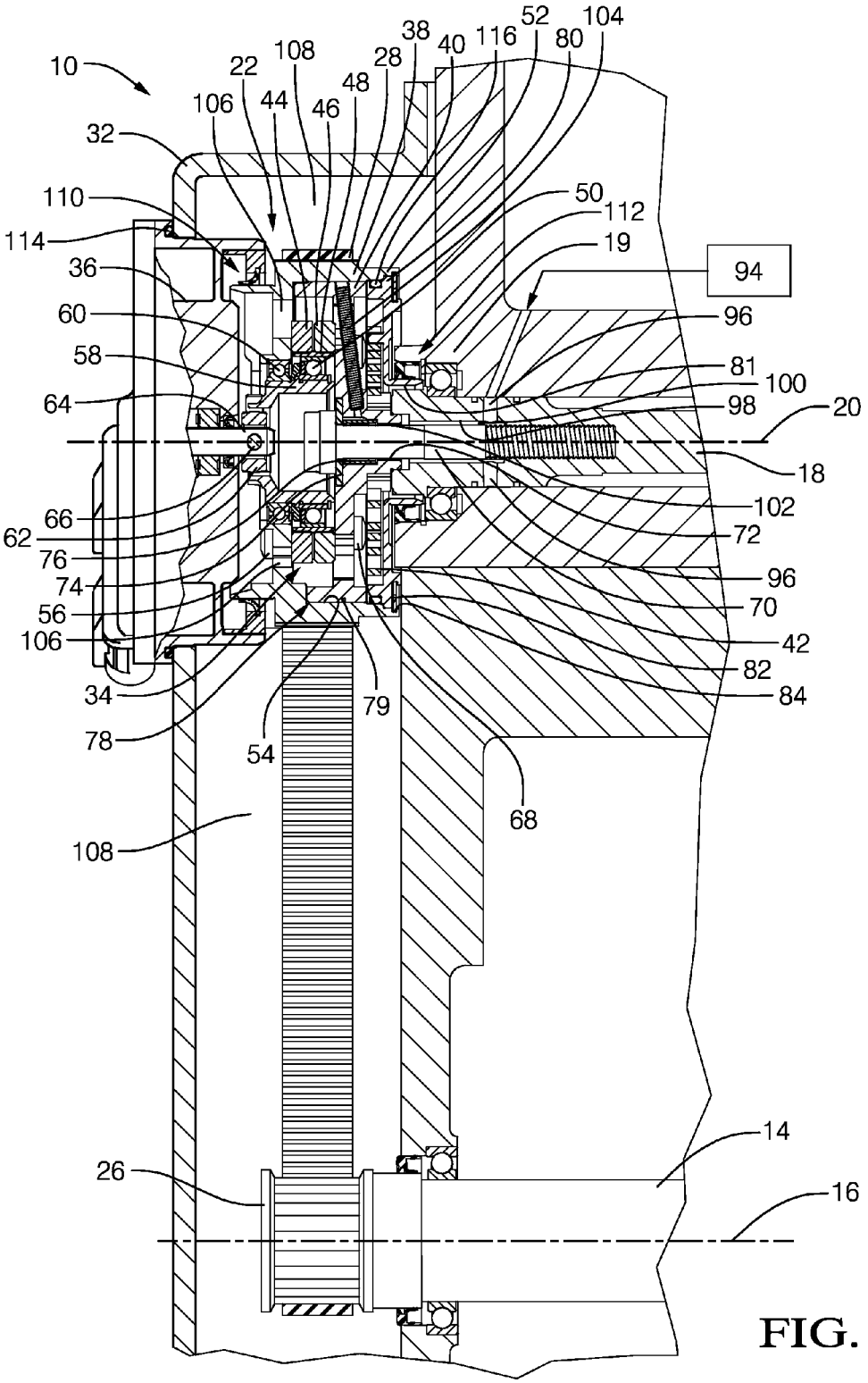
FIG. 2 is an axial cross-sectional view of the internal combustion engine accordance with the present invention.

Referring to FIGS. 1 and 2, an internal combustion engine 10 is shown in accordance with the present invention. Internal combustion engine 10 generally includes one or more pistons (not shown), a crankshaft 14 which rotates about a crankshaft axis 16, a camshaft 18 which is supported in a camshaft support 19 and rotates about a camshaft axis 20, and a camshaft phaser 22 which rotates about camshaft axis 20. Internal combustion engine 10 may be, for example only, spark ignited or compression ignited and may be fueled by any liquid fuel or gaseous fuel customarily used, for example only, liquid fuels such as gasoline, diesel fuel, alcohol, ethanol, and the like, and blends thereof or gaseous fuel such as natural gas, propane, and the like. The pistons, which are connected to crankshaft 14, reciprocate as a result of combustion of the fuel within respective combustion chambers (not shown). Reciprocation of the pistons causes crankshaft 14 to rotate about crankshaft axis 16. Crankshaft 14 includes a crankshaft sprocket 26 which rotates a drive member 28, for example, a drive belt. Camshaft phaser 22 is rotated by drive member 28 and connected to camshaft 18, consequently, camshaft 18 rotates about camshaft axis 20 as a result of crankshaft 14. Rotation of camshaft 18 about camshaft axis 20 causes one or more combustion valves (not shown) to open and close. The combustion valves may allow a charge of air and/or fuel into the combustion chambers and/or exhaust constituents out of the combustion chambers. Camshaft phaser 22 allows the phase of rotation of camshaft 18 relative to crankshaft 14 to be varied, thereby varying the timing of opening and/or closing of the combustion valves relative to crankshaft 14 as will be described in greater detail later. An engine cover 32 encloses crankshaft sprocket 26, drive member 28, and camshaft phaser 22.

Camshaft phaser 22 comprises a gear drive unit illustrated as a harmonic gear drive unit 34; a rotational actuator 36 operationally connected to harmonic gear drive unit 34; an input sprocket 38 operationally connected to harmonic gear drive unit 34 and driven by drive member 28 via crankshaft 14; an output hub 40 attached to harmonic gear drive unit 34 and mounted to an end of camshaft 18; and a bias spring 42 operationally disposed between output hub 40 and input sprocket 38. Rotational actuator 36, hereinafter referred to as electric motor 36, may be, for example only, a DC electric motor.

Harmonic gear drive unit 34 comprises an outer first spline 44 which may be either a circular spline or a dynamic spline as described below; an outer second spline 46 which is the opposite (dynamic or circular) of first spline 44 and is coaxially positioned adjacent first spline 44; a flexspline 48 disposed radially inwards of both first spline 44 and outer second 46 and having outwardly-extending gear teeth disposed for engaging inwardly-extending gear teeth on both first spline 44 and second spline 46; and a wave generator 50 disposed radially inwards of and engaging flexspline 48.

Flexspline 48 is a non-rigid ring with external teeth on a slightly smaller pitch diameter than the circular spline. Flexspline 48 is fitted over and elastically deflected by wave generator 50.

The circular spline is a rigid ring with internal teeth engaging the teeth of flexspline 48 across the major axis of wave generator 50.

The dynamic spline is a rigid ring having internal teeth of the same number as flexspline 48. The dynamic spline rotates together with flexspline 48 and serves as the output member. Either the dynamic spline or the circular spline may be identified by a chamfered corner at its outside diameter to distinguish one spline from the other. As shown, the chamfered corner has been used to identify second spline 46.

As is disclosed in the prior art, wave generator 50 is an assembly of an elliptical steel disc supporting an elliptical bearing, the combination defining a wave generator plug. A flexible bearing retainer surrounds the elliptical bearing and engages flexspline 48. Rotation of the wave generator plug causes a rotational wave to be generated in flexspline 48 (actually two waves 180° apart, corresponding to opposite ends of the major ellipse axis of the disc).

During assembly of harmonic gear drive unit 34, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 34 is thus a high-ratio gear transmission; that is, the angular phase relationship between first spline 44 and second spline 46 changes by 2% for every revolution of wave generator 50.

Of course, as will be obvious to those skilled in the art, the circular spline may instead have slightly more teeth than the dynamic spline has, in which case the rotational relationships described below are reversed.

Still referring to FIGS. 1 and 2, input sprocket 38 is rotationally fixed to a generally cup-shaped housing 52 that is fastened by bolts 56 to first spline 44. Housing 52, which acts as an input member, includes a housing bore 54 and extends along camshaft axis 20. A coupling adaptor 58 is mounted to wave generator 50 and extends through housing 52, being supported by a bearing 60 mounted in housing 52. A coupling 62 is mounted to a motor shaft 64 of electric motor 36 and pinned thereto by a pin 66. Coupling 62 engages coupling adaptor 58, permitting wave generator 50 to be rotationally driven by electric motor 36, as may be desired to alter the phase relationship between first spline 44 and second spline 46.

Output hub 40, which acts as an output member, is fastened to second spline 46 by bolts 68 and may be secured to camshaft 18 by a camshaft phaser attachment bolt 70 extending through an output hub axial bore 72 in output hub 40, and capturing a thrust washer 74 and a filter 76 recessed in output hub 40. Filter 76 is a band-type filter that may be a screen or mesh and may be made from any number of different materials that are known in the art of oil filtering. Radial run-out between housing 52 and output hub 40 is limited by a single journal bearing interface 78 between housing 52 (input hub) and output hub 40. Journal bearing interface 78 is lubricated by oil supplied to an oil groove 79 formed in either output hub 40 (shown) and/or in housing 52 (not shown). The supply of oil to oil groove 79 will be discussed in more detail later. Output hub 40 is retained within housing 52 by a back plate 80 disposed within housing 52 and by a snap ring 82 disposed in an annular groove 84 formed in housing 52. Back plate 80 includes a central back plate bore 81 extending axially therethrough to allow at least a portion of output hub 40 and/or camshaft 18 to extend through back plate 80.

Bias spring 42 is captured axially between output hub 40 and back plate 80. An inner spring tang 86 of bias spring 42 is engaged with output hub 40 while an outer spring tang 88 of bias spring 42 is engaged with back plate 80 by a pin 90 which is fixed to back plate 80. In the event of a malfunction of electric motor 36, bias spring 42 is biased to back-drive harmonic gear drive unit 34 without help from electric motor 36 to a predetermined rotational position of second spline 46. The predetermined position may be a position which allows internal combustion engine 10 to start or run, and the predetermined position may be at one of the extreme ends of the range of authority or intermediate of the phaser's extreme ends of its rotational range of authority. For example, the rotational range of travel in which bias spring 42 biases harmonic gear drive unit 34 may be limited to something short of the end stop position of the phaser's range of authority. Such an arrangement would be useful for internal combustion engines requiring an intermediate park position for idle or restart.

In order to lubricate various elements of camshaft phaser 22, oil is provided thereto under pressure from an oil source 94 of internal combustion engine 10. Oil source 94 may provide oil to camshaft phaser 22 through radial camshaft drillings 96 which communicate with a camshaft counterbore 98 which forms a camshaft annular oil passage 100 with a portion of camshaft phaser attachment bolt 70. The oil then passes from camshaft annular oil passage 100 to an output hub annular oil passage 102 formed radially between output hub axial bore 72 and a portion of camshaft phaser attachment bolt 70. Radial camshaft drillings 96, camshaft annular oil passage 100, and output hub annular oil passage 102 together define a supply passage. The oil is then filtered by passing radially through filter 76 to prevent contaminants that may be present in the oil from passing further into camshaft phaser 22. After passing through filter 76 the oil is then communicated to a tube 104 which extends generally radially outward from output hub axial bore 72 to oil groove 79 thereby allowing the oil to be communicated to oil groove 79 where the oil lubricates journal bearing interface 78. Journal bearing interface 78 allows oil to pass thereby in both an axial direction toward back plate 80 and an axial direction away from back plate 80. Oil that passes by journal bearing interface 78 in the axial direction away from back plate 80 is allowed to lubricate harmonic gear drive unit 34, bearing 60, and coupling 62 through gravity and dynamics of camshaft phaser 22 in use. In order for the oil to reach coupling 62, axial housing passages 106 may be provided through the axial end of housing 52. It should now be understood that additional oil passages may be provided, for example as disclosed in United States Patent Application Publication No. US 2012/0312258 A1 to Kimus et al., the disclosure of which is incorporated herein by reference in its entirety.

Drive member 28 may not be compatible with the oil used to lubricate camshaft phaser 22, consequently, a dry zone 108 may be formed within engine cover 32. Drive member 28 is located within dry zone 108 which is substantially free of the oil used to lubricate camshaft phaser 22. Dry zone 108 is formed by a sealing arrangement which may comprise a motor to camshaft phaser seal 110 and an engine to camshaft phaser seal 112. The sealing arrangement may also comprise an engine cover to motor seal 114 and a back plate to housing seal 116. The sealing arrangement will be described in greater detail in the paragraphs that follow.

Figure 3:
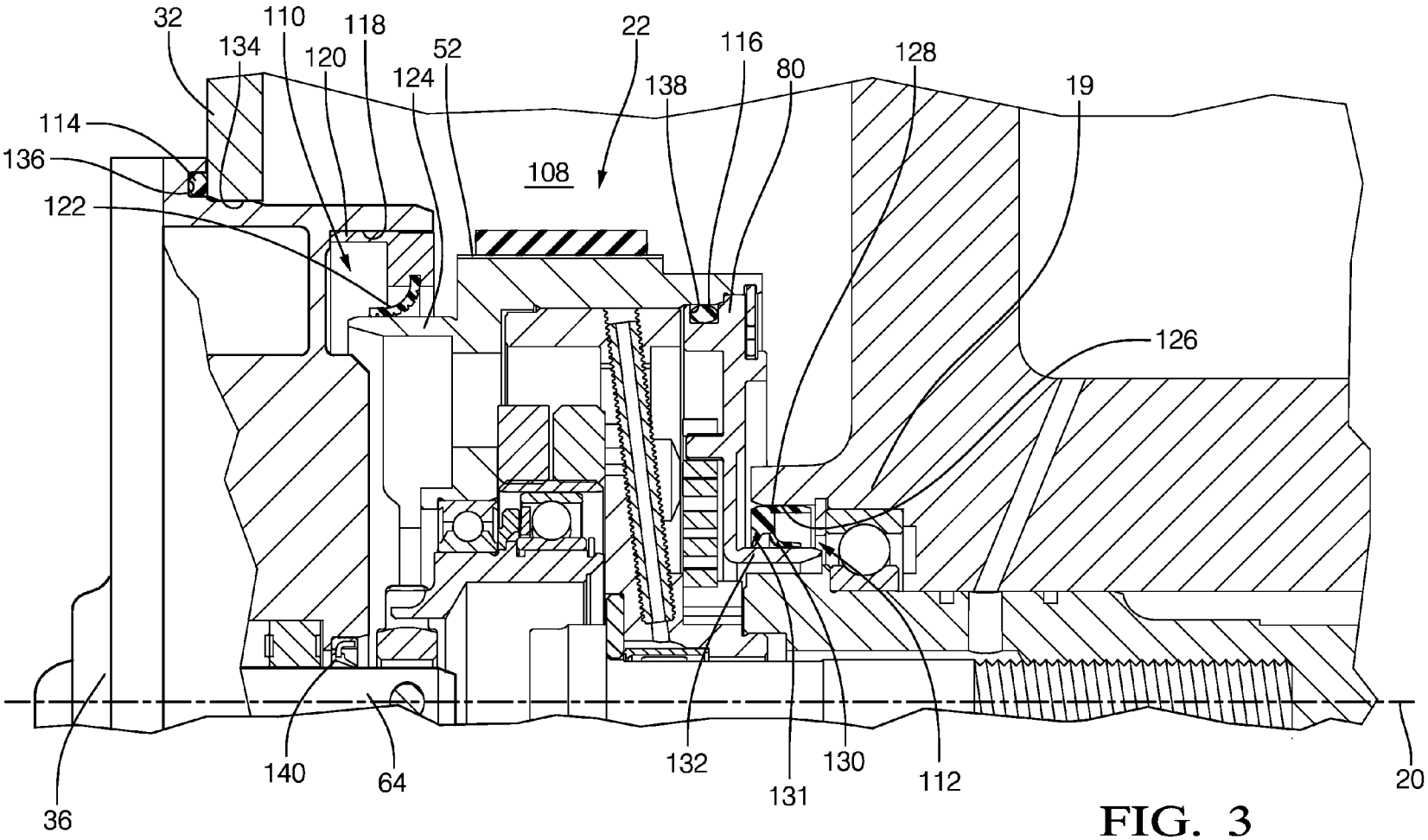
FIG. 3 is an enlargement of a portion of FIG. 2.

Referring now to FIG. 3, motor to camshaft phaser seal 110 provides a seal between electric motor 36 and housing 52. Electric motor 36 may define motor to camshaft phaser seal bore 118 which is substantially cylindrical in shape, centered about camshaft axis 20, and extends axially into electric motor 36. Motor to camshaft phaser seal 110 includes a motor to camshaft phaser seal supporting body 120 which is ring shaped and secured coaxially within motor to camshaft phaser seal bore 118, for example, by a press fit. Motor to camshaft phaser seal supporting body 120 may be made of a rigid material, for example, metal or plastic. Motor to camshaft phaser seal 110 also includes a motor to camshaft phaser seal lip seal 122 which extends radially inward from motor to camshaft phaser seal supporting body 120. Motor to camshaft phaser seal lip seal 122 may be molded and bonded to motor to camshaft phaser seal supporting body 120 and may be made of an elastomeric or rubber-like material, for example only, Nitrile Butadiene Rubber (NBR), Viton®, or silicone. Housing 52 includes a housing sealing body 124 for radially mating with motor to camshaft phaser seal lip seal 122. Housing sealing body 124 is ring-shaped and extends axially away from housing 52 toward electric motor 36 and into motor to camshaft phaser seal bore 118 in a coaxial relationship therewith. Housing sealing body 124 is sized to elastically deform motor to camshaft phaser seal lip seal 122 when assembled in order to provide an oil-tight seal between housing sealing body 124 and motor to camshaft phaser seal lip seal 122. Motor to camshaft phaser seal lip seal 122 is sized to provide sufficient compliance to accommodate mismatch in concentricity between motor to camshaft phaser seal 110 and housing sealing body 124 due to manufacturing tolerances. In this way, oil that exits the end of housing 52 which is proximal to electric motor 36 is prevented from entering dry zone 108 as camshaft phaser 22 rotates with respect to motor to camshaft phaser seal 110 in operation. In addition to motor to camshaft phaser seal lip seal 122, motor to camshaft phaser seal 110 may include a dust seal lip which protects motor to camshaft phaser seal lip seal 122 from external contamination that may have undesirable effects on motor to camshaft phaser seal lip seal 122.

Engine to camshaft phaser seal 112 provides a seal between camshaft support 19 and back plate 80. A camshaft support bore 126, which is cylindrical, extends into camshaft support 19 in a coaxial relationship with camshaft 18. Engine to camshaft phaser seal 112 includes an engine to camshaft phaser seal supporting body 128 which is ring shaped and secured coaxially within camshaft support bore 126, for example, by a press fit. Engine to camshaft phaser seal supporting body 128 may be made of a rigid material, for example, metal or plastic. Engine to camshaft phaser seal 112 also includes an engine to camshaft phaser seal lip seal 130 which extends radially inward from engine to camshaft phaser seal supporting body 128. Engine to camshaft phaser seal lip seal 130 may be molded and bonded to engine to camshaft phaser seal supporting body 128 and may be made of an elastomeric or rubber-like material, for example only, Nitrile Butadiene Rubber (NBR), Viton®, or silicone. Engine to camshaft phaser seal 112 may also include an engine to camshaft phaser seal dust lip seal 131 which extends radially inward from engine to camshaft phaser seal supporting body 128 and may be made from the same material as engine to camshaft phaser seal lip seal 130. Engine to camshaft phaser seal dust lip seal 131 protects engine to camshaft phaser seal lip seal 130 from external contamination that may have undesirable effects on engine to camshaft phaser seal lip seal 130. Back plate 80 includes a back plate sealing body 132 for radially mating with engine to camshaft phaser seal lip seal 130. Back plate sealing body 132 is ring-shaped and extends axially away from back plate 80 into camshaft support bore 126 in a coaxial relationship with camshaft support bore 126. Back plate sealing body 132 is sized to elastically deform engine to camshaft phaser seal lip seal 130 when assembled in order to provide an oil-tight seal between back plate sealing body 132 and engine to camshaft phaser seal lip seal 130.

Engine cover 32 includes an engine cover bore 134 extending therethrough in a substantially coaxial relationship with camshaft 18. Electric motor 36 is received coaxially within engine cover bore 134 and fixed to engine cover 32 to prevent relative rotation between engine cover 32 and electric motor 36. Engine cover to motor seal 114, which may be an O-ring as shown, fits within an engine cover to motor seal groove 136 formed on electric motor 36. Engine cover to motor seal 114 is compressed axially between engine cover to motor seal groove 136 and engine cover 32. In this way, oil that exits the end of housing 52 which is proximal to electric motor 36 is prevented from exiting engine cover 32 between the interface of engine cover 32 and electric motor 36. It should be noted that engine cover to motor seal 114 is a static seal, unlike motor to camshaft phaser seal 110 and engine to camshaft phaser seal 112 which are dynamic seals, since there is no relative movement between engine cover 32 and electric motor 36. Alternatively, engine cover to motor seal 114 may be arranged to interface in a radial sealing arrangement between electric motor 36 and engine cover 32.

Back plate to housing seal 116, which may be an O-ring as shown, fits within a back plate to housing seal groove 138 formed on the outer circumference of back plate 80. Back plate to housing seal 116 is compressed radially between back plate to housing seal groove 138 and housing 52. In this way, oil is prevented from entering dry zone 108 through the interface of back plate 80 and housing 52. It should be noted that back plate to housing seal 116 is a static seal, unlike motor to camshaft phaser seal 110 and engine to camshaft phaser seal 112 which are dynamic seals, since there is no relative movement between back plate 80 and housing 52.

In addition to motor to camshaft phaser seal 110, engine to camshaft phaser seal 112, engine cover to motor seal 114, and back plate to housing seal 116; the sealing arrangement may also comprise a motor to motor shaft seal 140. Motor to motor shaft seal 140 is positioned radially between electric motor 36 and motor shaft 64 to prevent oil from migrating into electric motor 36. As with motor to camshaft phaser seal 110 and engine to camshaft phaser seal 112, motor to motor shaft seal 140 is a dynamic seal since motor shaft 64 rotates relative to the rest of electric motor 36.

Figure 4:
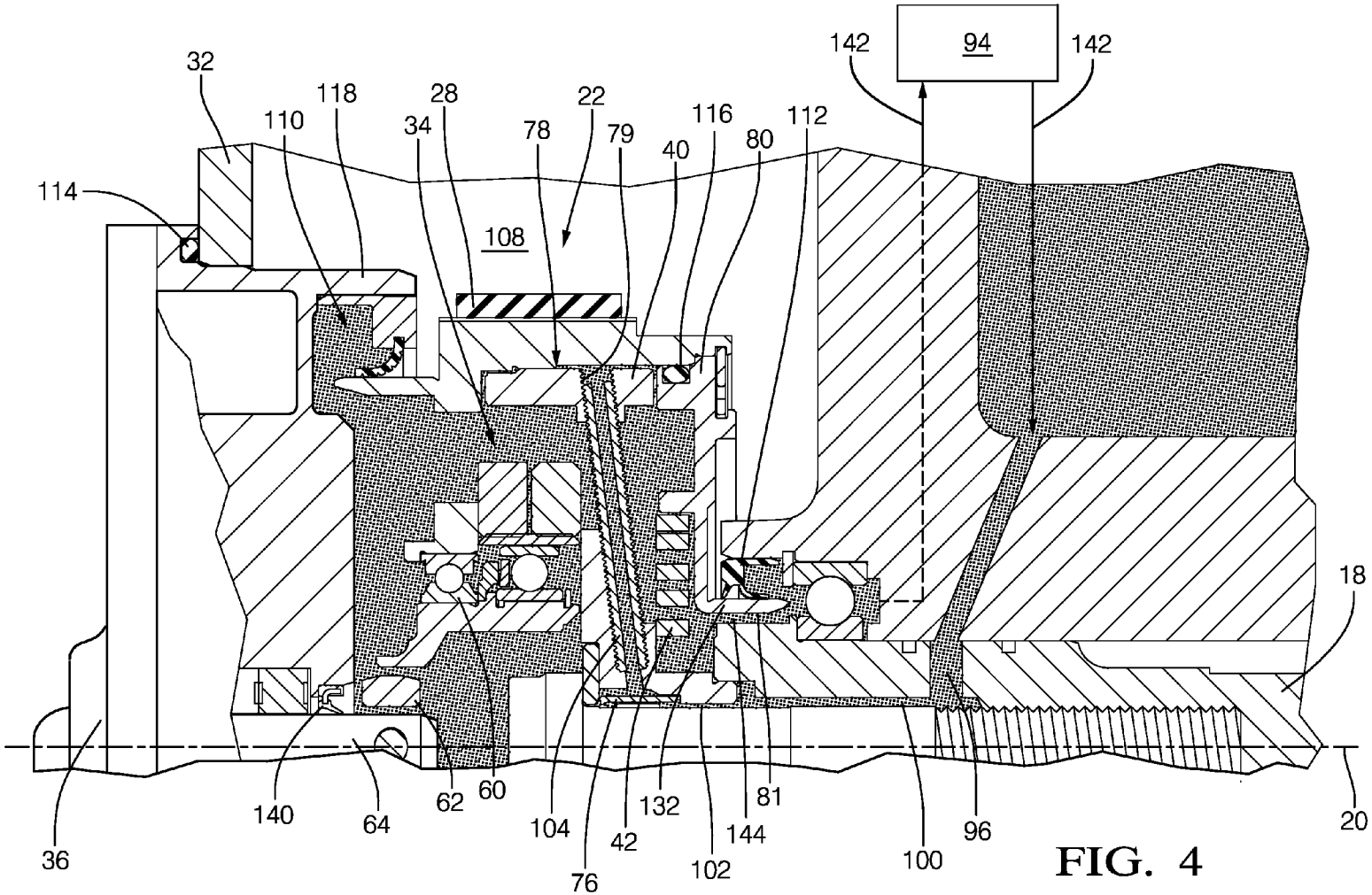
FIG. 4 is the enlargement of FIG. 3 showing the path oil takes which is used to lubricate a camshaft phaser.

Reference will now be made to FIG. 4 which illustrates the path taken by the oil used to lubricate camshaft phaser 22 where the path into and out of camshaft phaser 22 is represented by arrows 142 and the volume occupied by the oil is represented by stippling. Oil from oil source 94 is supplied under pressure to radial camshaft drillings 96 and subsequently to camshaft annular oil passage 100 and output hub annular oil passage 102. The oil is then passed through filter 76 and tube 104 in order to reach oil groove 79 to lubricate journal bearing interface 78. It should be noted that journal bearing interface 78 has been exaggerated in FIGS. 3 and 4 to more readily show the path taken by the oil to lubricate journal bearing interface 78, more specifically, the radial distance between housing 52 and output hub 40 has been exaggerated in FIGS. 3 and 4 to more readily show the path taken by the oil to lubricate journal bearing interface 78. The oil travels past journal bearing interface 78 both axially forward and axially rearward. The oil that travels axially forward from journal bearing interface 78 is communicated to harmonic gear drive unit 34, bearing 60, and coupling 62 for lubrication thereof. However, the oil that is communicated axially forward from journal bearing interface 78 is prevented from entering dry zone 108 and from exiting engine cover 32 by motor to camshaft phaser seal 110, engine cover to motor seal 114, and motor to motor shaft seal 140. After camshaft phaser 22 is sufficiently filled with oil, the oil that is communicated axially forward from journal bearing interface 78 flows axially rearward toward camshaft 18 and mixes with oil that is communicated axially rearward from journal bearing interface 78 in the area of camshaft phaser 22 that is axially between output hub 40 and back plate 80. The oil that is axially between output hub 40 and back plate 80 is prevented from entering dry zone 108 by back plate to housing seal 116 and is consequently communicated to the annular gap formed between camshaft 18 and back plate bore 81 which defines a drain passage 144 which communicates the oil back to oil source 94. The oil that is communicated to drain passage 144 is prevented from entering dry zone 108 by engine to camshaft phaser seal 112. In this way, camshaft phaser 22 is lubricated while preventing oil from being communicated to drive member 28.

The operation of camshaft phaser 22 will now be described with reference to FIGS. 1 and 2. When internal combustion engine 10 is operating, crankshaft 14 and crankshaft sprocket 26 rotate about crankshaft axis 16 as a result of the pistons reciprocating. Consequently, drive member 28 is rotated which in turn rotates camshaft phaser 22 and camshaft 18, thereby resulting in the combustion valves being opened and closed. When there is a desire to change the phase relationship between camshaft 18 and crankshaft 14, an electric current is supplied to electric motor 36 which causes motor shaft 64 to rotate. It should be noted that motor shaft 64 may be made to rotate either clockwise or counterclockwise depending on whether there is a desire to advance or retard the timing of camshaft 18 relative to crankshaft 14. Rotation of motor shaft 64 causes wave generator 50 to rotate which causes a rotational wave to be generated in flexspline 48, thereby causing first spline 44 to rotate relative to second spline 46. Since first spline 44 is fixed to housing 52 and second spline 46 is fixed to output hub 40, housing 52 also rotates relative to output hub 40, thereby changing the phase relationship between camshaft 18 and crankshaft 14.

Figure 5:
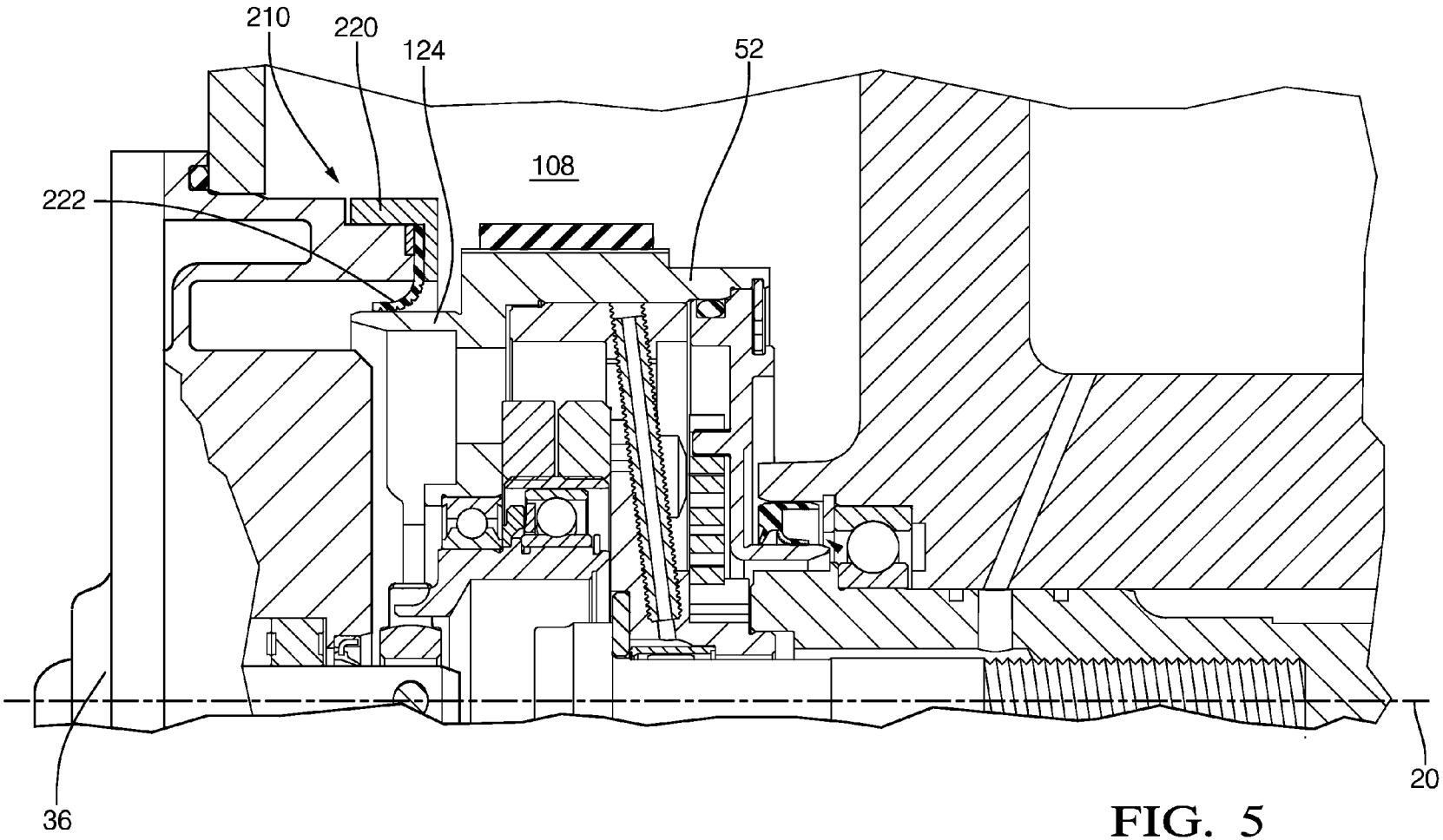
FIG. 5 is a first alternative sealing arrangement for defining the dry zone.

Reference will now be made to FIG. 5 which shows a first alternative sealing arrangement for defining dry zone 108. The sealing arrangement shown in FIG. 5 replaces motor to camshaft phaser seal 110 with motor to camshaft phaser seal 210. Motor to camshaft phaser seal 210 includes a motor to camshaft seal supporting body 220 which is ring shaped and secured coaxially around electric motor 36, for example, by a press fit. In other words, electric motor 36 is received coaxially within motor to camshaft phaser seal supporting body 220. Motor to camshaft phaser seal supporting body 220 may be made of a rigid material, for example, metal or plastic. Motor to camshaft phaser seal 210 also includes a motor to camshaft phaser seal lip seal 222 which extends radially inward from motor to camshaft phaser seal supporting body 220. Motor to camshaft phaser seal lip seal 222 may be molded and bonded to motor to camshaft phaser seal supporting body 220 and may be made of an elastomeric or rubber-like material, for example only, Nitrile Butadiene Rubber (NBR), Viton®, or silicone. Housing sealing body 124 of housing 52 radially mates with motor to camshaft phaser seal lip seal 222 just as with motor to camshaft phaser seal lip seal 122 as described above to provide an oil-tight seal. In this way, oil that exits the end of housing 52 which is proximal to electric motor 36 is prevented from entering dry zone 108 as camshaft phaser 22 rotates with respect to motor to camshaft phaser seal 210 in operation.

Figure 6:
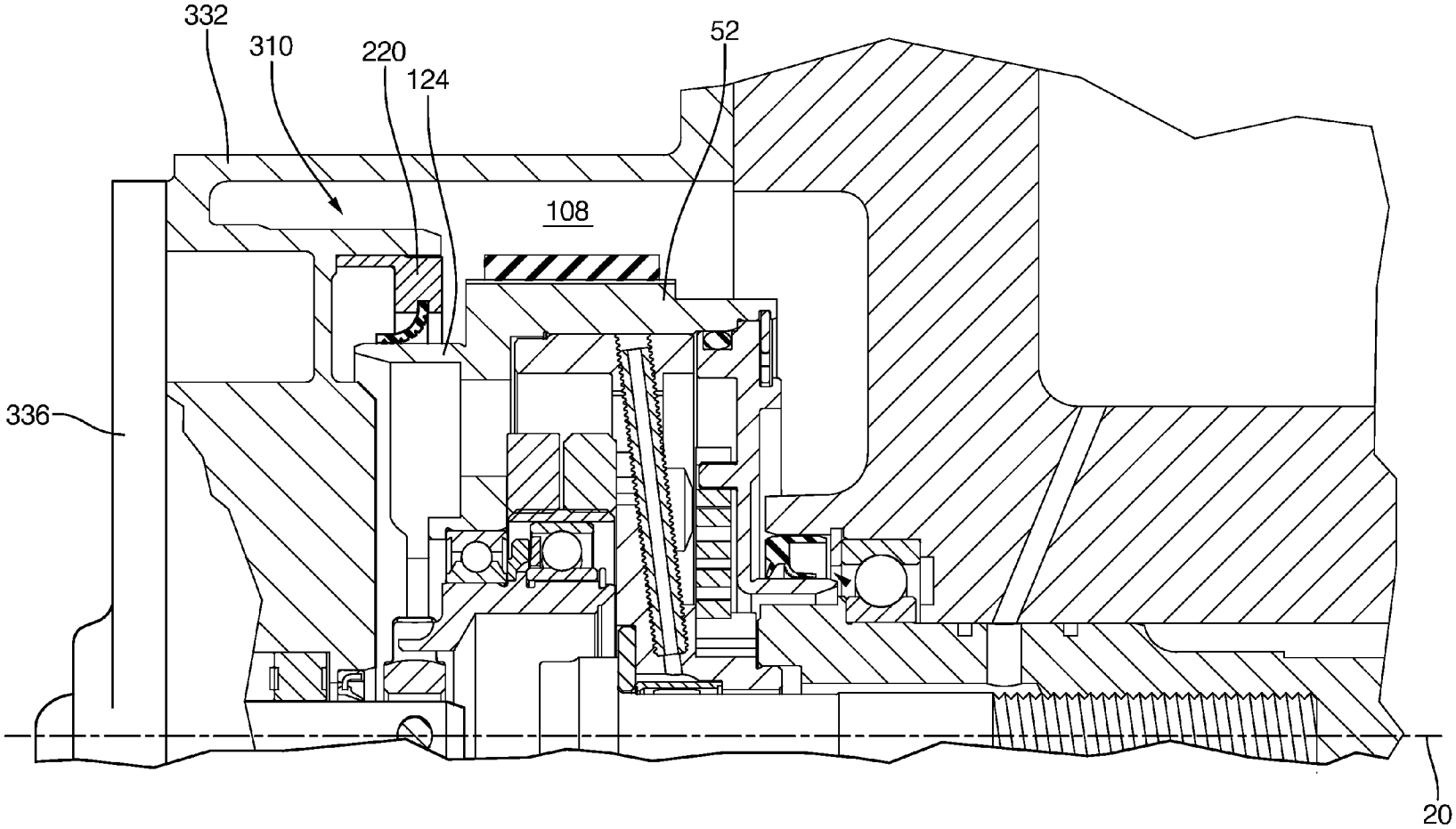
FIG. 6 is a second alternative sealing arrangement for defining the dry zone.

Reference will now be made to FIG. 6 which shows a second alternative sealing arrangement for defining dry zone 108. The sealing arrangement shown FIG. 6 is substantially the same as the sealing arrangement shown FIGS. 1-4 except that electric motor 36 has been replaced with electric motor 336 which is formed integrally as part of engine cover 332 rather than being a separate component that is subsequently fastened thereto. Since electric motor 336 is formed integrally as part of engine cover 332, engine cover to motor seal 114 is omitted. A motor to camshaft phaser seal 310 is mounted with electric motor 336 and mates with housing sealing body 124 of housing 52 in similar fashion as motor to camshaft phaser seal 110 described above relative to FIGS. 1-4. In this way, oil that exits the end of housing 52 which is proximal to electric motor 336 is prevented from entering dry zone 108 as camshaft phaser 22 rotates with respect to motor to camshaft phaser seal 310 in operation.

Figure 7:
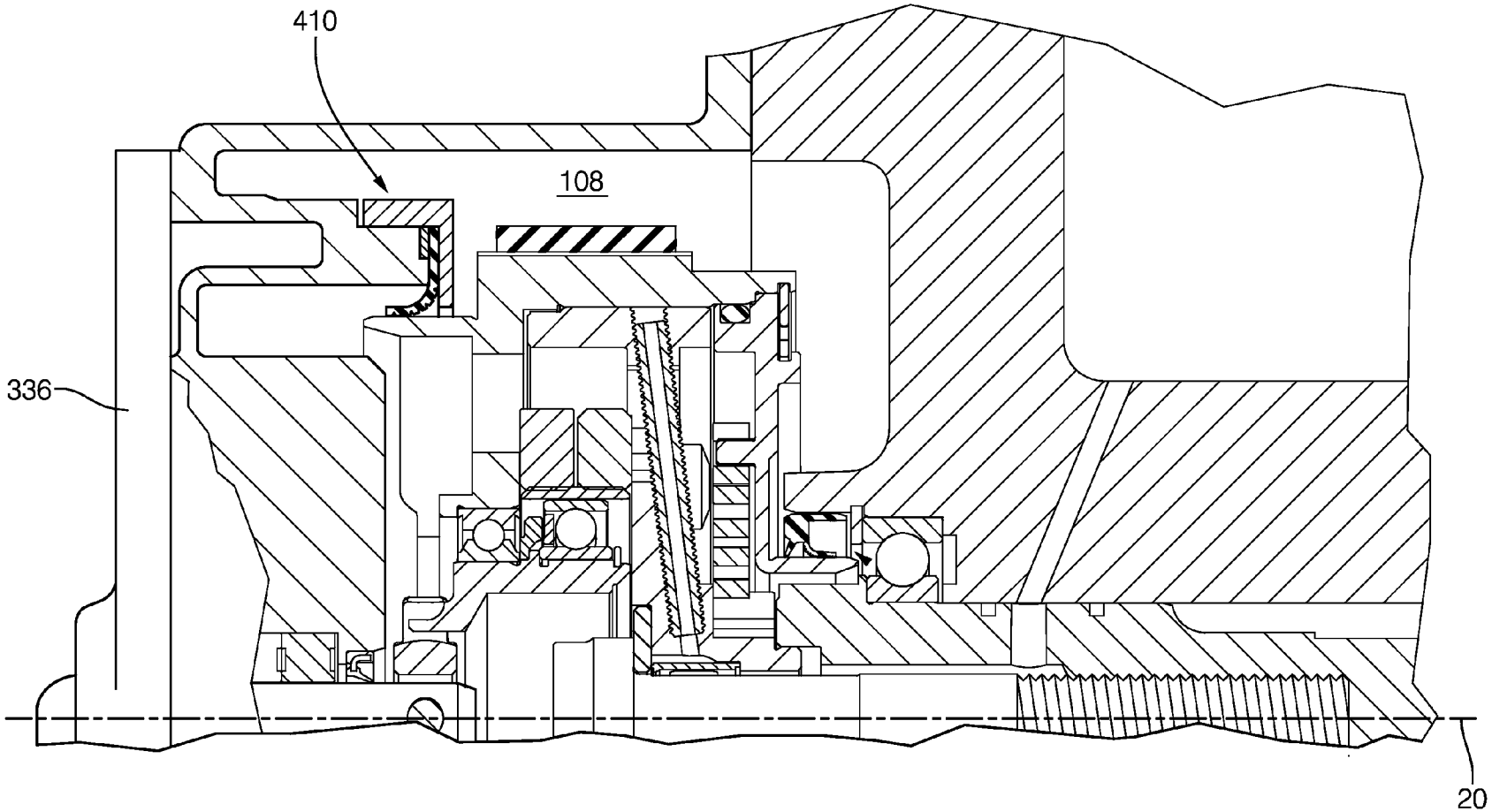
FIG. 7 is a third alternative sealing arrangement for defining the dry zone.

Reference will now be made to FIG. 7 which shows a third alternative sealing arrangement for defining dry zone 108. The sealing arrangement shown in FIG. 7 is substantially the same as shown in FIG. 6 except that motor to camshaft phaser seal 310 is replaced with a motor to camshaft phaser seal 410 which is mounted to electric motor 336 in similar fashion as motor to camshaft phaser seal 210 as described previously with respect to FIG. 5.

The embodiment described herein describes harmonic gear drive unit 34 as comprising first spline 44 which may be either a circular spline or a dynamic spline which serves as the input member; an second spline 46 which is the opposite (dynamic or circular) of first spline 44 and which serves as the output member and is coaxially positioned adjacent first spline 44; a flexspline 48 disposed radially inwards of both first and second splines 44, 46 and having outwardly-extending gear teeth disposed for engaging inwardly-extending gear teeth on both first and second splines 44, 46; and a wave generator 50 disposed radially inwards of and engaging flexspline 48. As described, harmonic gear drive unit 34 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inwards of the circular spline and having outwardly-extending gear teeth disposed for engaging inwardly-extending gear teeth on the circular spline; and a wave generator disposed radially inwards of and engaging the flexspline.

While the gear drive unit of camshaft phaser 22 has been described herein as harmonic gear drive unit 34, it should now be understood that the invention encompasses camshaft phasers using any known gear drive units. Other gear drive units that may be used within the scope of this invention include, by non-limiting example, spur gear units, helical gear units, worm gear units, hypoid gear units, planetary gear units, and bevel gear units.

While the invention has been described by reference to various specific embodiments, it should be understood that numerous changes may be made within the spirit and scope of the inventive concepts described. Accordingly, it is intended that the invention not be limited to the described embodiments, but rather only to the extent set forth in the claims that follow.

We claim:

1. An internal combustion engine having a crankshaft rotatable about a crankshaft axis and a camshaft rotatable by the crankshaft about a camshaft axis, said internal combustion engine comprising:

a) an oil source;

b) an engine cover;

c) a drive member disposed within said engine cover for transferring rotational motion from said crankshaft to said camshaft;

d) a camshaft phaser disposed within said engine cover for controllably varying the phase relationship between said crankshaft and said camshaft, said camshaft phaser comprising:

i) an input member driven by said drive member;

ii) an output member rotatable with said camshaft;

iii) a gear drive unit connecting said input member to said output member; and iv) an electric motor connected to said gear drive unit to impart rotation on said gear drive unit such that rotation of said gear drive unit causes relative rotation between said input member and said output member;

e) a supply passage for communicating oil, in use, from said oil source to said camshaft phaser in order to lubricate said camshaft phaser;

f) a drain passage for draining oil, in use, from said camshaft phaser to said oil source; and g) a sealing arrangement defining a dry zone within said engine cover to isolate said drive member from oil used to lubricate said camshaft phaser, wherein said sealing arrangement comprises a seal to seal between said electric motor and said camshaft phaser.

2. An internal combustion engine as in claim 1 wherein:

said input member is a housing having a housing bore with a longitudinal axis;

said gear drive unit is a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, wherein one of said circular spline and said dynamic spline is fixed to said housing in order to prevent relative rotation therebetween;

said output member is an output hub rotatably disposed within said housing axially adjacent to said harmonic gear drive unit and attached to said camshaft and fixed to the other of said circular spline and said dynamic spline in order to prevent relative rotation therebetween; and said electric motor is connected to said wave generator to impart rotation on said wave generator such that rotation of said wave generator causes relative rotation between said circular spline and said dynamic spline.

3. An internal combustion engine as in claim 1 wherein said seal is a radial seal.

4. An internal combustion engine as in claim 1 wherein said camshaft phaser rotates relative to said seal.

5. An internal combustion engine as in claim 2 wherein said electric motor includes a seal bore extending axially thereinto and said seal is fixed to said seal bore.

6. An internal combustion engine as in claim 5 wherein said housing includes a ring-shaped housing sealing body extending axially from said housing toward said electric motor such that said seal seals against said housing sealing body.

7. An internal combustion engine as in claim 6 wherein said housing sealing body extends into said seal bore.

8. An internal combustion engine as in claim 2 wherein said seal is fixed to said motor at an interface of said seal radially surrounding said motor.

9. An internal combustion engine as in claim 8 wherein:

said electric motor includes a seal bore extending axially thereinto; and said housing includes a ring-shaped housing sealing body extending axially from said housing into said motor to camshaft seal bore such that said seal seals against said housing sealing body.

10. An internal combustion engine as in claim 1 where said electric motor is integrally formed as part of said engine cover.

11. An internal combustion engine as in claim 10 wherein said electric motor includes a seal bore extending axially thereinto and said seal is fixed to said seal bore.

12. An internal combustion engine as in claim 2 where said electric motor is integrally formed as part of said engine cover.

13. An internal combustion engine as in claim 12 wherein said electric motor includes a seal bore extending axially thereinto and said seal is fixed to said seal bore.

14. An internal combustion engine as in claim 13 wherein said housing includes a ring-shaped housing sealing body extending axially from said housing toward said electric motor such that said seal seals against said housing sealing body.

15. An internal combustion engine as in claim 14 wherein said housing sealing body extends into said seal bore.

16. An internal combustion engine as in claim 8 wherein said seal is fixed to said motor at an interface of said seal radially surrounding said motor.

17. An internal combustion engine as in claim 16 wherein:

said electric motor includes a seal bore extending axially thereinto; and said housing includes a ring-shaped housing sealing body extending axially from said housing into said motor to camshaft seal bore such that said seal seals against said housing sealing body.

18. An internal combustion engine having a crankshaft rotatable about a crankshaft axis and a camshaft rotatable by said crankshaft about a camshaft axis, said internal combustion engine comprising:

a) an oil source;

b) an engine cover;

c) a drive member disposed within said engine cover for transferring rotational motion from said crankshaft to said camshaft;

d) a camshaft phaser disposed within said engine cover for controllably varying the phase relationship between said crankshaft and said camshaft, said camshaft phaser comprising:

i) a housing having a housing bore with a longitudinal axis;

ii) a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, wherein one of said circular spline and said dynamic spline is fixed to said housing in order to prevent relative rotation therebetween;

iii) an output hub rotatably disposed within said housing axially adjacent to said harmonic gear drive unit and attached to said camshaft and fixed to the other of said circular spline and said dynamic spline in order to prevent relative rotation therebetween; and iv) an electric motor connected to said wave generator to impart rotation on said wave generator such that rotation of said wave generator causes relative rotation between said circular spline and said dynamic spline;

e) a supply passage for communicating oil, in use, from said oil source to said camshaft phaser in order to lubricate said camshaft phaser;

f) a drain passage for draining oil, in use, from said camshaft phaser to said oil source; and g) a sealing arrangement defining a dry zone within said engine cover to isolate said drive member from oil used to lubricate said camshaft phaser, wherein said sealing arrangement comprises a seal to seal between said electric motor and said camshaft phaser.

* * * * *